United States Patent [19]

Roy

[11] 4,349,942

[45] Sep. 21, 1982

[54] EASEL HINGE CONSTRUCTION

[75] Inventor: Leo T. Roy, South Attleboro, Mass.

[73] Assignee: Craft, Inc., South Attleboro, Mass.

[21] Appl. No.: 188,765

[22] Filed: Sep. 22, 1980

[51] Int. Cl.[3] ..... E05D 1/04

[52] U.S. Cl. ..... 16/376; 16/356

[58] Field of Search ..... 16/191, 178, 356, 376

[56] References Cited

U.S. PATENT DOCUMENTS

| | | | |
|---|---|---|---|
| 1,569,619 | 1/1926 | Cranzler | 16/376 |
| 2,811,741 | 11/1957 | Miller et al. | 16/376 |
| 3,994,045 | 11/1976 | Roy | 16/178 |
| 4,050,117 | 9/1977 | Roy | 16/178 |

*Primary Examiner*—Werner H. Schroeder

*Assistant Examiner*—Andrew M. Falik

*Attorney, Agent, or Firm*—Salter & Michaelson

[57] ABSTRACT

An easel hinge for supporting picture frames and the like comprising an outer hinge plate and an inner hinge plate, both having curled barrels, the inner barrel being positioned within the outer barrel for relative rotational movement therewith without the use of a separate hinge pin. At least one opening is provided in the outer barrel and a tang is provided projecting upwardly from the inner barrel and extending into said outer barrel opening. The full arcuate separation between the plates causes the tang to engage a lower edge of the opening in the outer plate to limit the degree of angular separation between the plates.

9 Claims, 11 Drawing Figures

EASEL HINGE CONSTRUCTION

BACKGROUND AND SUMMARY OF THE INVENTION

This invention is directed to a hinge of the type permitting a limited relative angular separation between the plates thereof and in which no separate hinge pin is used to assemble or to hold such plates in operative position. Such hinges, although of general utility, have special application in the interconnection of the support and backing means of easel type picture frames. Accordingly, they are generally referred to as easel hinges.

Hinge constructions of this type are generally known and the prior art includes my previous patents, namely, U.S. Pat. No. 3,994,045 issued Nov. 30, 1976, and U.S. Pat. No. 4,050,117 issued Sept. 27, 1977. Both of these patents disclose highly desirable easel hinge constructions in which inner and outer hinge plates, both having curled barrels, are assembled for relative rotational movement with respect to each other. Occasionally, with such constructions, the application of a relatively large force in attempting to open the plates a further degree than is normally permitted can result in an unintended distortion on bending of one or both of the plates thereby breaking the hinge. It would therefore be desirable to avoid such unintended damage or breakage without otherwise detracting from the operation and function of such hinge constructions. A further desirable feature is the provision of a hinge construction of the above-indicated type that is of simple, low-cost construction and which can be readily made and assembled on presently available automatic machinery.

These and other objects of the present invention are accomplished by the provision of a stop means including at least one opening positioned in the outer barrel and in which an upwardly directed tang extends thereinto such that upon relative motion between said inner and outer barrels, the tang abuts the lower edge of the outer barrel opening so as to limit relative opening of the hinge to the desired extent and to simultaneously prevent respective longitudinal travel of one plate with respect to the other.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
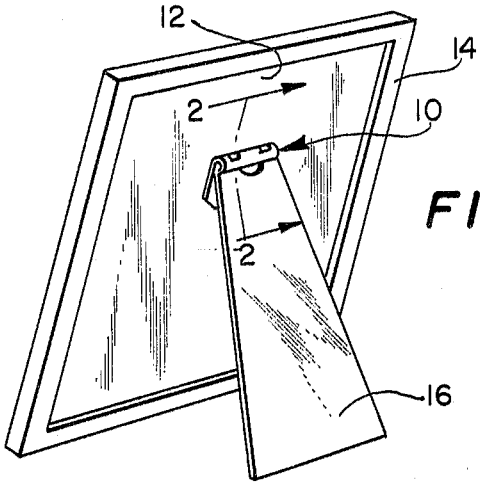
FIG. 1 is a perspective view of a hinge constructed in accordance with the instant invention applied to an easel type picture frame.
Figure 2:
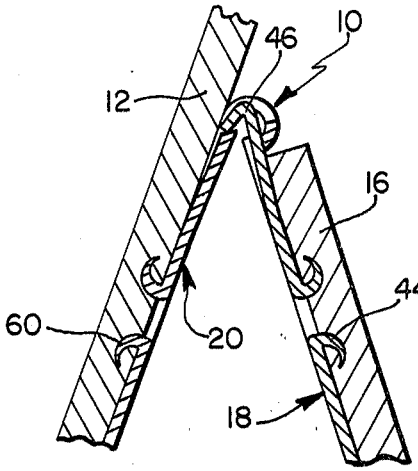
FIG. 2 is an enlarged sectional view taken along the line 2—2 of FIG. 1.

Referring now to the drawing and particularly FIGS. 1 and 2 thereof, an easel hinge constructed in accordance with the instant invention and shown generally at 10 serves to connect backing 12 of frame 14 to its support leg 16. The easel hinge 10 includes an inner hinge plate 18 and an outer hinge plate 20 both formed from any suitably stiff but workable materials such as sheet metal.

Figure 3:
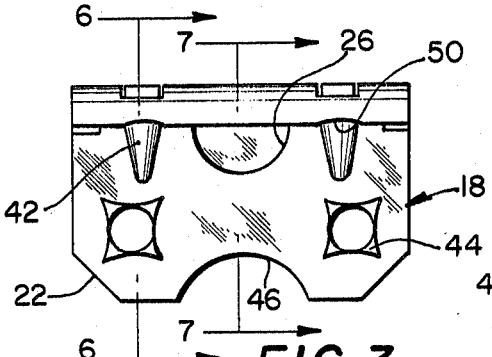
FIG. 3 is a front plan view of the easel hinge of the present invention in assembled condition.
Figure 4:
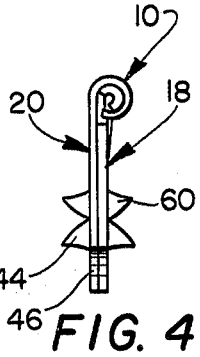
FIG. 4 is a side view thereof.
Figure 9:
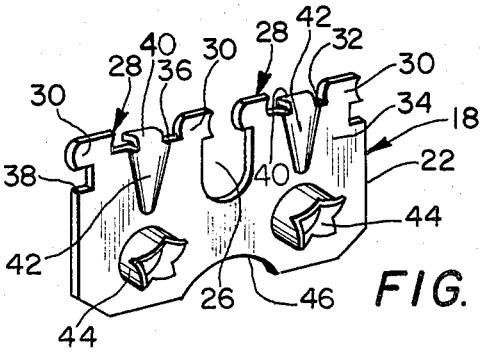
FIG. 9 is a perspective view showing the inner hinge plate of the present construction prior to the full formation of the inner curls or barrel thereof.

The construction of the inner hinge plate 18 as best shown in FIGS. 3 and 9 includes a leaf portion 22 terminating at its upper end in a curled inner barrel 24. The leaf 22 includes a centrally disposed, open top, generally U-shaped opening 26 which divides the inner barrel 24 into two longitudinally spaced segments. Each such segment 28 in turn includes a pair of longitudinally spaced sections 30. The spacing of the sections 30 is provided for by a downwardly extending generally U-shaped notch 32. The separate barrel sections 30 are connected to the leaf portion 22 by means of connecting webs 34 which in addition to the barrel segment 30 terminate at their upper ends in an edge surface 36 which in part defines the U-shaped notch 32. A tang 40 rearwardly extends from the upper edge 36 of each of such notches 32. Also, each of the connecting webs 34 is further provided with a stiffening dap 42. It should be further pointed out that the illustration shown in FIG. 9 is that of a partially formed inner plate and that when the inner barrel 24 is fully curled, the tang 40 will extend downwardly and rearwardly for a purpose which will hereinafter be more fully evident. The daps 42 are generally of triangular configuration and are immediately adjacent, that is, they project below the upper edge 36 of the webs 34. The lateral extension of the daps 42 is also preferably outwardly in the same direction as the rosettes 44 which are provided such that the inner plate 18 may be attached to the supporting leg 16 of the easel shown in FIGS. 1 and 2 of the drawing.

Figure 5:
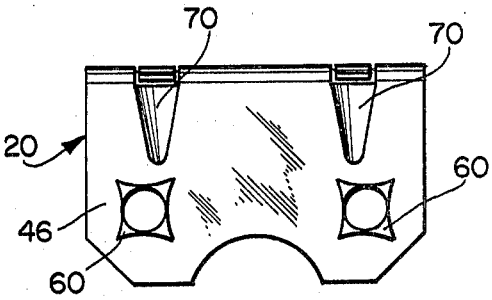
FIG. 5 is a rear plan view thereof.
Figure 8:
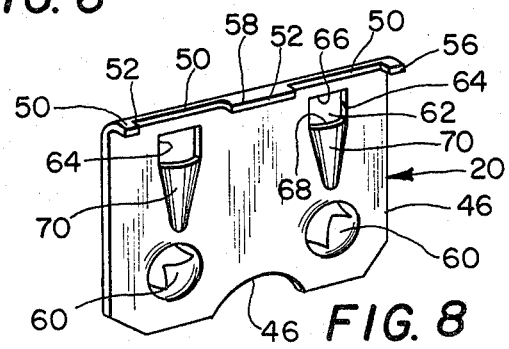
FIG. 8 is a perspective view showing the outer hinge plate of the present construction prior to the formation of the full outer curl or barrel thereof.

Turning now to FIGS. 5 and 8, the construction of the outer hinge plate 20 is best shown, said plate 20 including an outer leaf 46 in turn provided with an outer barrel 48 at the upper end thereof. The barrel 48 in turn is provided with relatively closed and relatively open barrel portions 50 and 52 respectively, it being further apparent that the relatively closed portions are particularly formed by a pair of projecting end tongues 56 and a centrally disposed tongue 58 which project from the terminal edge of the outer curl or barrel 48 inwardly towards the inner surface of the outer leaf 46. It is the open portions 50 that permit the limited relative opening of the hinge plates 18 and 20 as hereinafter will be made more apparent.

The outer hinge plate 20 is also provided with rosettes 60 similar to rosettes 44 of the inner hinge plate 22 for the purpose of connecting to the backing portion 12 of the easel frame shown in FIGS. 1 and 2. Additionally, the outer plate 20 is provided with a pair of longitudinally spaced openings 62 in turn defined by a pair of longitudinally spaced upper and lower edges 66 and 68 respectively. The leaf 46 is in turn provided with a pair of daps 70 inwardly extending in the same direction as the outer curl 48, of generally triangular configuration, and positioned adjacent and beneath the lower edges 68 which in part define the spaced openings 62. It should be noted that the illustration of outer plate 20 in FIG. 8 of the drawing is, as previously mentioned with regard to the inner leaf 18, of partially rolled configuration and that when the outer barrel 48 is fully rolled or formed, the openings 62 will be positioned within the outer barrel, as shown in the assembly views of the plates 18 and 20, namely, FIGS. 3 through 7*a*.

Figure 6:
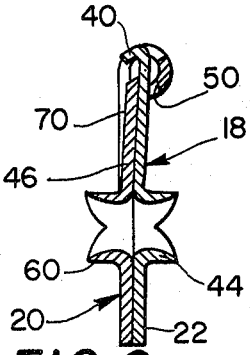
FIG. 6 is a sectional view taken along the line 6—6 of FIG. 3.
Figure 6A:
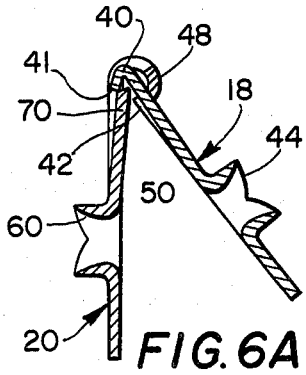
FIG. 6*a* is a view similar to FIG. 6 but with the hinge in its fully opened position.
Figure 7:
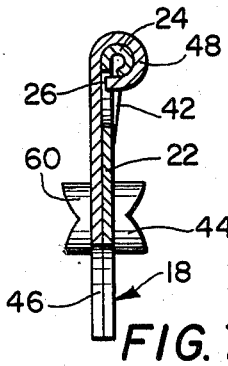
FIG. 7 is a sectional view taken along the line 7—7 of FIG. 3.
Figure 7A:
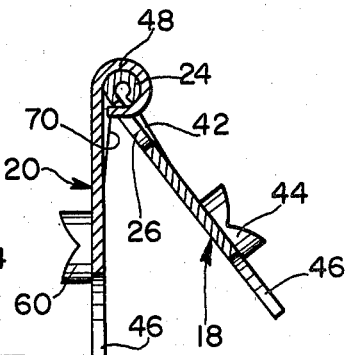
FIG. 7*a* is a view similar to FIG. 7 but with the hinge in its fully opened position.

The full curling or rolling of the inner and outer barrles take place when the hinge plates 18 and 20 shown in FIGS. 8 and 9 are assembled relative to each other such that they are aligned with their inner faces in face to face contact. Thereafter, automatic machinery such as is available in the art completes the curled formation of the inner and outer barrels as previously explained such that the projecting edge tongues 56 of the outer barrel will project into the notches 38 of the inner plate 18 and the tongue 58 into opening 26 thereof. In this manner then, the projection of the tongue 58 through the opening 26 not only serves to form at least one relatively tightly closed outer barrel portion 52 which more tightly envelopes underlying portions 30 of the inner barrel 24, but further serves as a means for preventing relative longitudinal movement between hinge plates 18 and 20. Additionally, in such assembled position each of the tangs 40 of the inner plate 18 upwardly project into a respective opening 62 of the outer curl 48 such that the side edges of each tang 40 is further adapted to abut the opposed side edges 64 of the opening 62 and thus form additional stop means for preventing longitudinal movement of the plates 18 and 20 with respect to each other. The rearward downward projection of the tangs 40 also causes the terminal edges 41 of the tangs to abut the lower edges 68 of the openings 62 when the plates are in their fully open position to provide additional means by which the opening movement of the plates 18 and 20 with respect to each other is limited. It should also be pointed out that in the assembled position of the plates 18 and 20, the opening relative movement therebetween is additionally limited by the abutment of the outer portions of the inner leaf 22, that is, the connecting web portions 34 thereof including the daps 42, with those portions of the longitudinal free edge of the outer barrel 48 forming the relatively open portions 50 thereof. Such coaction is best shown by reference to FIGS. 6 and 6*a* of the drawing werein the terminal edge 50 is respectively shown in spaced and contacting relationship with the outer surface of the leaf 22 including the dap 42.

Such coaction as above described between the outer edge of the outer curl 48 and the inner plate 22 is adapted to simultaneously occur with the abuting coaction of the tangs 40 with the edges 68 of the outer curl openings 62 and thus provide for two independent and simultaneously acting stop means so as to insure that the desired opening movement of the plates 18 and 20 is securely limited in the intended manner. It should also be pointed out that the daps 42 in the inner leaf 22 stiffen such leaf particularly in the web areas 34 thereof such that force applied to the inner plate 22 against the inner edge of the outer curl 48 will not cause a transverse bending of the webs 34 which is possible with prior art construction, as when the easel hinge is attempted to be forced apart by the application of excessive force. In a similar manner, the strengthening or stiffening daps 70 provided in the outer plate 20 not only prevent the possible transverse bending of the outer plate 20 in an opposite arcuate direction to that as might occur in the inner plate 18, but further provide an added degree of rigidity to the lower edge surface 68 in part defining the outer barrel opening 62 so as to prevent tearing, distortion and the like to those portions of the outer leaf 46 adjacent the openings 62 when contacted by the tangs 40.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In an easel hinge construction including an outer hinge plate and an inner hinge plate directly interconnected to each other for relative arcuate movement therebetween without a hinge pin, said outer hinge plate having a relatively flat leaf portion terminating in a curved barrel at the upper end thereof, said inner hinge plate also having a relatively flat leaf portion terminating in a curved barrel at its upper end, said inner barrel being positioned within said outer barrel for relative rotational movement so as to permit acute angular separation between said hinge plates from a closed position wherein the inner sides of said leaves are face-to-face to a relatively open position, the improvement comprising positive stop means for simultaneously preventing longitudinal sliding movement between said plates and for limiting the degree of angular separation therebetween in said open position, said stop means including at least one opening in said outer barrel, said outer barrel opening defined by a pair of longitudinally spaced side edges and a longitudinally extending lower edge, said inner barrel having a tang upwardly extending into said outer barrel opening, said tang engaging said outer barrel opening edges to prevent said longitudinal sliding movement, the terminal end of said tank engaging said lower edge when said plates are in their open position to thereby limit said angular separation.

2. The easel hinge construction of claim 1, said lower edge defining an upper edge of said outer leaf and positioned adjacent said outer barrel, said tang including a downwardly extending finger in turn adapted to abut said lower edge so as to limit said angular separation.

3. The easel hinge construction of claim 1, said inner hinge leaf portion having at least one opening therethrough, said inner leaf portion opening adjacent to and disposed longitudinally of said inner barrel, said outer barrel terminating in a longitudinal free edge directed towards the inner side of said outer leaf and having at least one portion thereof proximate said inner side to define a closed barrel portion, the remaining portions thereof spaced from said inner side to define an open barrel portion, said closed barrel portion being aligned with and projecting through said inner leaf opening and generally completely enveloping portions of said inner barrel positioned therewithin, while permitting relative rotational movement therewith and preventing longitudinal movement of said plates with respect to each other, such respective barrel positioning also permitting angular separation between said plates from a fully closed position wherein the inner sides of said leaves are face-to-face to a fully open position wherein the outer side of said inner leaf abuts the longitudinal free edge of said outer barrel open portion.

4. In an easel hinge construction including an outer hinge plate and an inner hinge plate directly interconnected to each other for relative arcuate movement therebetween without a hinge pin, said outer hinge plate having a relatively flat leaf portion terminating in a curved barrel at the upper end thereof, said inner hinge plate also having a relatively flat leaf portion terminating in a curved barrel at its upper end, said inner barrel being positioned within said outer barrel for relative rotational movement so as to permit acute angular separation between said hinge plates from a closed position wherein the inner sides of said leaves are face-to-face to a relatively open position, the improvement comprising positive stop means for simultaneously preventing longitudinal sliding movement between said plates and for limiting the degree of angular separation therebetween in said open position, said stop means including at least one opening in said outer barrel, said outer barrel opening defined by a pair of longitudinally spaced side edges and a longitudinally extending lower edge, said lower edge defining an upper edge of said outer leaf, said outer leaf further including a stiffening dap extending downwardly adjacent said upper edge, said inner barrel having a tang upwardly extending into said outer barrel opening, said tang adapted to abut said lower edge so as to limit said angular separation and to contact said outer barrel opening side edges to prevent said longitudinal sliding movement.

5. In an easel hing construction including an outer hinge plate and an inner hinge plate directly interconnected to each other for relative arcuate movement therebetween without a hinge pin, said outer hinge plate having a relatively flat leaf portion terminating in a curved barrel at the upper end thereof, said inner hinge plate also having a relatively flat leaf portion terminating in a curved barrel at its upper end, said inner barrel being positioned within said outer barrel for relative rotational movement so as to permit acute angular separation between said hinge plates from a closed position wherein the inner sides of said leaves are face-to-face to a relatively open position, the improvement comprising positive stop means for simultaneously preventing longitudinal sliding movement between said plates and for limiting the degree of angular separation therebetween in said open position, said stop means including at least one opening in said outer barrel, said outer barrel opening defined by a pair of longitudinally spaced side edges and a longitudinally extending lower edge, said inner barrel having a tang upwardly extending into said outer barrel opening, said tang adapted to abut said lower edge so as to limit said angular separation and to contact said outer barrel opening side edges to prevent said longitudinal sliding movement, said inner hinge leaf portion having at least one opening therethrough, said inner leaf portion opening adjacent to and disposed longitudinally of said inner barrel, said outer barrel terminating in a longitudinal free edge directed toward the inner side of said outer leaf and having at least one portion thereof proximate said inner side to define a closed barrel portion, the remaining portions thereof spaced from said inner side to define an open barrel portion, said closed barrel portion being aligned with and projecting through said inner leaf opening and generally completely enveloping portions of said inner barrel positioned therewithin, while permitting relative rotational movement therewith and preventing longitudinal movement of said plates with respect to each other, such respective barrel positioning also permitting angular separation between said plates from a fully closed position wherein the inner sides of said leaves are face-to-face to a fully open position wherein the outer side of said inner leaf abuts the longitudinal free edge of said outer barrel open portion, said inner barrel being connected to said inner leaf by means of at least one connecting web, said web including a stiffening dap and said longitudinal free edge of said outer barrel open portion being adapted to contact said inner leaf web and said dap in said fully open position.

6. The easel hinge of claim 5, said tang centrally disposed relative to said inner barrel so as to define longitudinally spaced inner barrel sections.

7. The easel hinge of claim 5, said tang centrally disposed relative to said inner barrel so as to define longitudinally spaced inner barrel sections, said inner leaf opening being centrally disposed so as to define spaced connecting web portions on longitudinally disposed opposite sides thereof, said outer barrel closed portion comprising a tongue projecting through said opening, said tongue having opposed sides thereof disposed proximal to the side portions of said inner leaf opening.

8. In an easel hinge construction including an outer hinge plate and an inner hinge plate directly interconnected to each other for relative arcuate movement therebetween without a hinge pin, said outer hinge plate having a relatively flat leaf portion terminating in a curved barrel at the upper end thereof, said inner hinge plate also having a relatively flat leaf portion terminating in a curved barrel at its upper end, said inner barrel being positioned within said outer barrel for relative rotational movement so as to permit acute angular separation between said hinge plates from a closed position wherein the inner sides of said leaves are face-to-face to a relatively open position, the improvement comprising positive stop means for simultaneously preventing longitudinal sliding movement between said plates and for limiting the degree of angular separation therebetween in said open position, said stop means including at least one opening in said outer barrel, said outer barrel opening defined by a pair of longitudinally spaced side edges and a longitudinally extending lower edge, said inner barrel having a tang upwardly extending into said outer barrel opening, said tang adapted to abut said lower edge so as to limit said angular separation and to contact said outer barrel opening side edges to prevent said longitudinal sliding movement, both said barrels being curled in the same direction while said tang extends in the opposite direction.

9. The easel hinge construction of claim 8, said inner hinge leaf portion having at least one opening therethrough, said inner leaf portion opening adjacent to and disposed longitudinally of said inner barrel, said outer barrel terminating in a longitudinal free edge directed towards the inner side of said outer leaf and having at least one portion thereof proximate said inner side to define a closed barrel portion, the remaining portions thereof spaced from said inner side to define an open barrel portion, said closed barrel portion being aligned with and projecting through said inner leaf opening and generally completely enveloping portions of said inner barrel positioned therewithin, while permitting relative rotational movement therewith and preventing longitudinal movement of said plates with respect to each other, such respective barrel positioning also permitting angular separation between said plates from a fully closed position wherein the inner sides of said leaves are face-to-face to a fully open position wherein the outer side of said inner leaf abuts the longitudinal free edge of said outer barrel open portion.

* * * * *